US005293017A

United States Patent [19]

Bartlett

[11] Patent Number: 5,293,017

[45] Date of Patent: Mar. 8, 1994

[54] RIGHT ANGLE ELASTOMERIC CONTROL SWITCH

[75] Inventor: Michael H. Bartlett, Coral Springs, Fla.

[73] Assignee: Motorola, Inc., Schaumburg, Ill.

[21] Appl. No.: 955,172

[22] Filed: Oct. 1, 1992

[51] Int. Cl.[5] ..... H01H 1/14

[52] U.S. Cl. ..... 200/511; 200/292; 200/512

[58] Field of Search ..... 200/511, 517, 512, 292, 200/278, 264; 361/350, 351, 413

[56] References Cited

U.S. PATENT DOCUMENTS

| | | | |
|---|---|---|---|
| 3,562,466 | 2/1971 | McElligott | 200/275 X |
| 3,852,878 | 12/1974 | Munro | 361/413 X |
| 3,924,915 | 12/1975 | Conrad | 361/413 X |
| 4,114,000 | 9/1978 | Feder | 200/511 X |
| 4,117,279 | 9/1978 | Schoemer . | |
| 4,164,634 | 8/1979 | Gilano | 200/517 X |
| 4,227,774 | 7/1983 | Benoist | 340/825.44 |
| 4,368,369 | 1/1983 | Matsumoto et al. | 200/517 X |
| 4,390,758 | 6/1983 | Hendrickson | 200/511 X |
| 4,692,571 | 9/1987 | Trinh et al. . | |
| 4,719,322 | 1/1988 | Guzik et al. . | |
| 4,916,262 | 4/1990 | Jungels-Butler et al. . | |
| 4,922,070 | 5/1990 | Dorinski . | |
| 5,146,615 | 9/1992 | Hodson et al. . | |

FOREIGN PATENT DOCUMENTS

| | | | |
|---|---|---|---|
| 3520992 | 12/1986 | Fed. Rep. of Germany | 200/292 |

*Primary Examiner*—Renee S. Luebke
*Attorney, Agent, or Firm*—Juliana Agon

[57] ABSTRACT

A switch assembly comprises a substrate (10) having conductive traces providing contacts (23) on the substrate (10) and a connector (21) positioned over the substrate (10). The connector (10) includes an actuator area (33) and a selectively conductive area (22) located perpendicular to the actuator area (33). The selectively conductive area (22) is located over the contacts (23) and is made electrically conductive with the contacts (23), when the connector (21) is shorted with an actuator, the actuator area being at a fight angle to the conductive traces.

6 Claims, 2 Drawing Sheets

RIGHT ANGLE ELASTOMERIC CONTROL SWITCH

BACKGROUND OF THE INVENTION

The present invention relates to switch assemblies in general and particularly to elastomeric type switches.

Elastomeric switches are used in many electronic devices such as appliance control panels, automotive dashboards, consumer toys, industrial controls, and control panels for radios, such as in a keypad assembly. This type of switch enjoys several advantages over conventional rocker, toggle or key switches. They can provide a liquid tight front surface, making them quite useful in environments where a switch or switch assembly might be exposed to liquid spills, corrosive chemicals, or moisture. They offer a reduced thickness, due to the absence of mechanical parts such as springs, rockers, wiring fasteners, and large housings. This feature is extremely desirable in applications such as thin calculators and other portable consumer electronic devices that must be worn on the person or carried in a pocket. Because of the absence of such parts, they have a lower cost of materials and assembly. This factor is quite important in consumer electronics. They provide a momentary contact, as opposed to permanent contact switch. This is important in applications such as calculators where a circuit is meant to be only briefly actuated.

A typical elastomeric switch is constructed much like a conventional switch, that is a movable contact is used to momentarily complete the connection between two sides of a circuit that are normally not connected. In flat elastomeric switches, often called membrane switches, the normally nonconnected sides of the circuit are formed on the surface of a rigid or flexible printed circuit board. The printed circuit board is usually placed underneath the switch actuator assembly. The bottom printed circuit board usually contains other circuitry to interconnect the switch or switches to the remainder of the electronic device.

However, when the elastomeric switch is used in an electronic product where the controls are at fight angles to the main bottom circuit board, such as in a front panel assembly for a mobile radio, the switch printed circuit board is usually placed on a side, in parallel with and behind the switch actuator assembly. One such side orientation uses the switch board assembly—a printed circuit board, or flex circuit, with popple domes, mechanical switches, or elastomeric membrane switches assembled to it—mounted to a structure that orients it at a right angle to the main board surface.

The conventional elastomeric switch board assembly, mounted on a side or flat, often includes a movable contact which consists of a flexible plastic sheet having a conductive area that serves to complete the circuit on the printed circuit board, underneath, when it is moved into contact on top of it. The conductive area on the flexible sheet is arranged so as to be facing the circuit board and is aligned so as to be directly opposite the stationary contacts on the circuit board. When a force is applied to the exterior side of the flexible sheet, the movable contact is displaced into engagement with the stationary contact to close the switch.

With all of its subcomponents, this switch board assembly still has to be electrically connected to the main printed circuit board by some additional structure. Hence, in the conventional universal front panel assembly, the side printed circuit board is an additional component to the bottom printed circuit board. This side board is hoped to be eliminated, along with other components.

One mounting approach to eliminate the additional side printed circuit board utilizes through-hole mechanical switches that are attached to a frame which supports the switches at a right angle to the board surface. Therefore, what is needed is a reduction in necessary component parts for a perpendicularly mounted control panel while providing the advantages of thinness of the elastomeric switches.

SUMMARY OF THE INVENTION

Briefly, according to the invention, a switch assembly comprises a substrate having conductive traces providing contacts on the substrate and a connector member positioned over the substrate. The connector member includes an actuator area and a selectively conductive area located perpendicular to the actuator area. The selectively conductive area is located over the contacts and is made electrically conductive with the contacts, when the connector member is shorted, at the actuator area, at a right angle to the conductive traces.

DESCRIPTION OF THE PREFERRED EMBODIMENT

Figure 1:
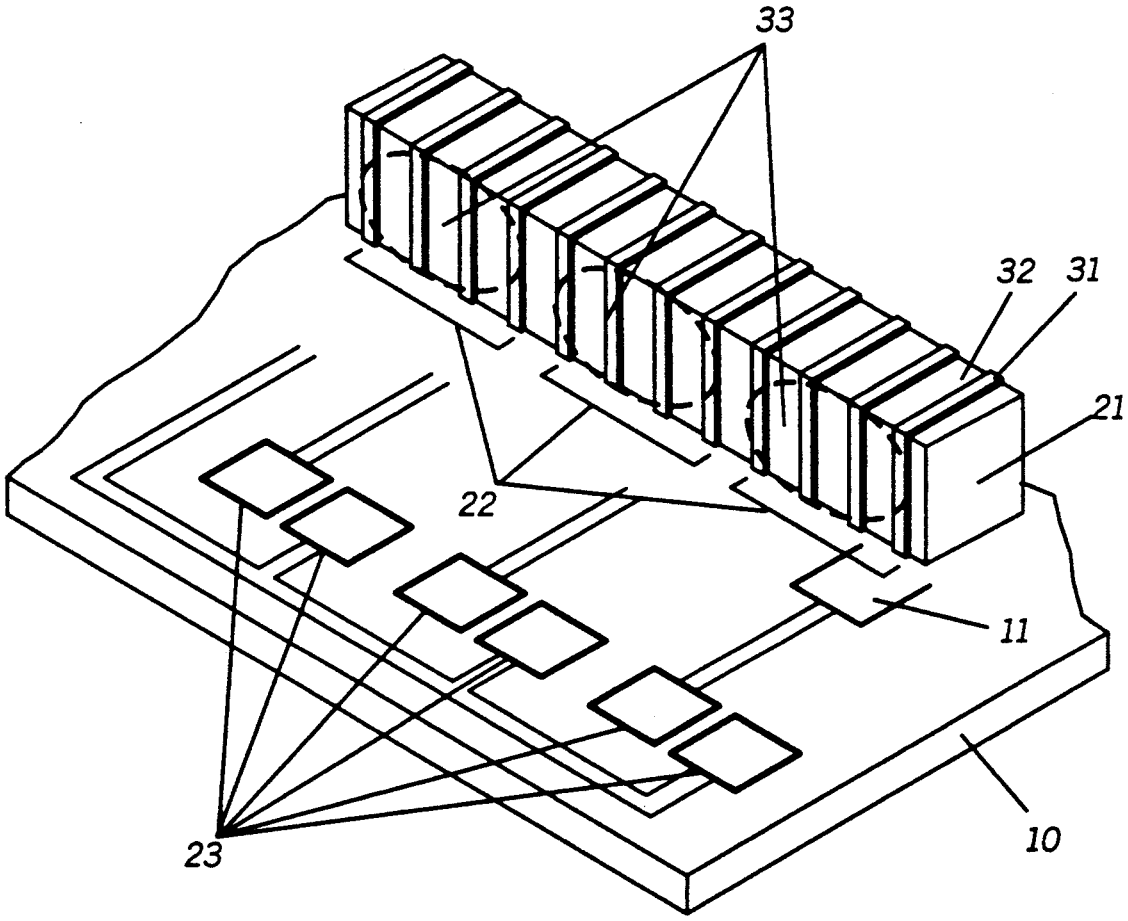
FIG. 1 a perspective view of a switch assembly in accordance with the present invention showing the connector member separated from the assembly.
Figure 2:
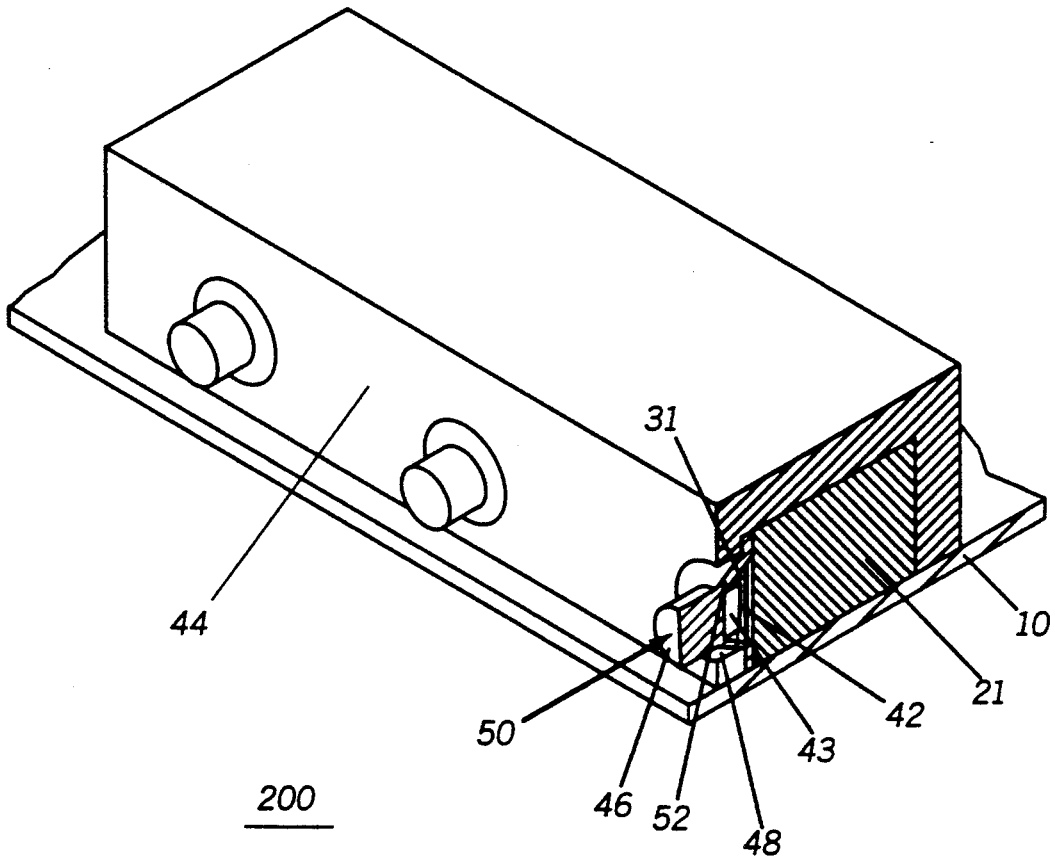
FIG. 2 is a partial cross-sectional view of the switch assembly in a housing.

Referring to FIGS. 1 and 2, a switch assembly is used in a control or front panel assembly 200, having push-button keys, for a mobile radio. The control assembly 200 can easily be used as a keypad assembly on the side of a microphone, or in other suitable applications.

In FIG. 1, the switch assembly is shown without push-button keys to illustrate a portion 1 00 of the assembly in greater detail. The switch assembly includes a multipath high-density connective member such as an elastomeric connector 21. The connector is preferably flexible to compensate for mechanical tolerances. In one embodiment, such a connector 21 sold under the name ZEBRA ®, made by TECKNIT ®, includes alternating layers of conductive (31) and non-conductive (32) silicone rubber wherein the edges of the conductive layer form the stripes 31 shown on the sides of the rectangular connector 31. Preferably, the conductive layer is carbon filled. Furthermore, the contact density of the connector is substantially greater than the contact pad density of the printed circuit (PC) board such that when the connector 21 is placed on a PC board 1 0, at least one conductive layer 31 will connect matched contact pads 23 and at least one insulating layer 32 will isolate adjacent circuits. Contact density is defined to be the number of conductive layers 31 per inch.

Even though the conductive portions 31 are shown with some thickness extending past the insulating portions 32, for emphasis, the extensions are not necessary to form this rectangular connector having substantially flat sides. It is also appreciated that only two perpendicular sides of the connector 21 need to have the stripes 31 disposed therein, in other embodiments.

One of the perpendicular sides of the connector 21 has an actuator area, such as a selectively shorting or electrically conductive area 33 having the shape of a "pill" of an elastomeric switch 46 (shown in FIG. 2). The other perpendicular side carries a striped metalized contact or selectively shorting contact area 22 on the bottom of the elastomeric connector 21 having corresponding conductive stripes. Normally, the elastomeric connector 21, specifically the area 22, is not shorted to anything. When pressed, the stripes 31 touched by the conductive pill in the shorting area 33 are shorted to the same potential at the corresponding conductively shorting area 22.

A Series 1006 ZEBRA® Connector is specifically made by Tecknit® for right angle assembly. Once mounted, the Series 1006 ZEBRA® Connector conducts in a 90° direction. Whether this specific ZEBRA® connector or another is used, the generic elastomeric connector 21 is placed on a substrate, such as the printed circuit board 10. The printed circuit board 10 includes two sides of a circuit 1 1 that are normally not electrically connected. The selective shorting contact 22 touches a pair of corresponding stationary contacts 23 of the normally not electrically connected circuit. Since the selectively shorting contact 22 is always touching the stationary contacts 23 (even though there may not be an electrical connection), there is no need for a spacer in between. A striped or any other suitable pattern which can be formed as interdigitated fingers, for the disconnected circuit is incorporated into the printed circuit board 10 where each stripe of the pattern is a side of the switch. Preferably, the material of the stationary striped contacts 23 is copper. This copper interdigital pattern is plated over with gold or printed over with carbon ink.

When the actuator area 33 of the connector member 21 is pressed, its selectively shorting area 22 completes the circuit on the printed circuit board 10 wherein the area 22 is shorted to the corresponding stationary contacts 23.

As a separate or integral part of a push-button or control key, a collapsible resilient dome 43, or other suitable shape, of a pressure sensitive conductive elastomeric switch 46, shown in FIG. 2, includes a conductive underside or the bottom conductive pill 42 which shorts out the selectively shorting area 33 of the elastomeric connector 21. The conductive underside 42 possesses the typical pressure sensitive conductor elastomer characteristic wherein as pressure is applied, the pill decreases its resistance from high to low to provide an electrical short for the area 33 contacted.

In operation, a force 50 is applied to short the conductive underside 42 of the switch 46 with the selectively shorting area 33 of the first side of the connector member 21. This first side is perpendicular to the surface of the printed circuit board 10 and is also perpendicular to the second side of the connector 21 containing the corresponding selectively shorting contact 22. Obviously, the second side is parallel to the surface of the PC board 10. The conductive pill 42 shorts the area 33 with the conductive contact 22, which, in turn, shorts the stationary contacts 23 to close the switching circuit on the PC board 10.

Thus, closing one pair of the stationary contacts 23 is performed by actuating the elastomeric dome, in the lateral direction, until the conductive "pill" touches the stripes 31 of the elastomeric connector 21. When the control or push-button key is pressed, the dome collapses which results in a switch closure, i.e., electrical continuity between conductors or stationary contacts 23 on the printed circuit board 10, by way of one or more conductors or striped contacts 31.

Referring to FIG. 2, the elastomeric connector 21 and the elastomeric switch 46 are placed together into an electrically insulative housing 44 which aligns and supports the two elastomeric parts causing the elastomeric connector to press against the pattern on the printed circuit board 10.

The control assembly 200 includes a front panel of the insulative housing 44. Protruding from the face of the front panel housing 44 is a plurality of switch controls of associated actuator or elastomeric switch assembly 46. A typical elastomeric switch 46 includes the resilient popple 43 which is disposed to support a corresponding or integral push-button key. Each of the popple has a conductive underside 42, surrounded and supported by a rib 52 of the elastomeric switch 46.

These controls or actuators extend through appropriate openings 48 in the front panel and are accessible to the user. The actuators are activated by depressing inwardly to make contact with the associated switching elements internal to the front panel assembly 44.

Once the connector member 21 is placed over the printed circuit board 10, the elastomeric dome of the elastomeric control switch 46, placed perpendicular to the board 10, can be depressed, so that the moveable underside contact of the control, the conductive pill 42, engages the striped conductive lines 31 to short the contacts 23 of FIG. 1 in order to complete the electrical circuit.

It will be understood that the invention is not limited to a single switch on a housing or case, but may also be an array of switches, such as a control panel or membrane switch pad. Such a control panel would include a plurality of contacts 22 on the connector member 21. Each of the contacts 22 would be engageable with corresponding contacts 23 in separate areas of the housing. The housing can be integrated into the product's enclosure, thereby eliminating the need of a separate part. Furthermore, the printed circuit board can be integrated into the product's enclosure, thereby eliminating the need of a separate printed circuit board.

We claim:

1. A switch assembly comprising:

a substrate having conductive traces providing connectors on the substrate;

a resilient, multiple conductive contact material having a plurality of electrically isolated conductors extending between planar surfaces of the multiple conductive contact material, the contact material positioned over the substrate to be continuously in contact with the connectors, the multiple conductive contact material electrically engaging each of the connectors at a large number of separate and isolated electrical engagement regions; and a pressure sensitive conductive elastomeric switch having switch contacts coupled to a pressure sensitive conductive underside, the conductive underside providing switch closure electrical coupling between the switch contacts, the switch disposed in perpendicular relationship to the connectors of the substrate to force the conductive underside into engagement with the conductors, the elastomeric switch having resiliency to provide a return bias force tending to maintain the switch contacts in an open condition and being biased towards a nonactuated, open contact position at the switch contacts, and the conductive underside being coupled into switch closure engagement with the switch contacts and electrically coupling the conductors and the connectors to the closed switch contacts in response to operator actuation of the pressure sensitive conductive underside.

2. A switch assembly comprising:

a substrate having conductive traces providing connectors on the substrate;

a resilient, multiple conductive contact material having a plurality of electrically isolated conductors extending between planar surfaces of the multiple conductive contact material, the contact material positioned over the substrate, the multiple conductive contact material electrically engaging each of the connectors at a large number of separate and isolated electrical engagement regions; and a pressure sensitive conductive elastomeric switch having switch contacts coupled to a pressure sensitive conductive underside, the conductive underside providing switch closure electrical coupling between the switch contacts, the switch disposed in perpendicular relationship to the connectors of the substrate to force the conductive underside into engagement with the conductors, the elastomeric switch having resiliency to provide a return bias force tending to maintain the switch contacts in an open condition and being biased towards a nonactuated, open contact position at the switch contacts, and the conductive underside being coupled into switch closure engagement with the switch contacts and electrically coupling the conductors and the connectors to the closed switch contacts in response to operator actuation of the pressure sensitive conductive underside.

3. The switch assembly of claim 2, wherein the conductor of the multiple conductive contact material comprises a portion of an elastomeric connector having the side edge and the bottom edge disposed on two perpendicular sides of the elastomeric connector.

4. The switch assembly of claim 2, wherein the multiple conductive contact material comprises a plurality of alternating layers of conductive and nonconductive material wherein the edges of the conductive layers form a plurality of conductors disposed on at least two perpendicular sides of the multiple conductive contact material.

5. The switch assembly of claim 2, further comprising an insulative means for supporting the pressure sensitive conductive elastomeric switch resting against the multiple conductive contact material, and aligning the multiple conductive contact material to press against the conductive traces on the substrate.

6. A switch assembly for a mobile radio, comprising:

a substrate having conductive traces providing connectors on the substrate;

a resilient, multiple conductive contact material having a plurality of electrically isolated conductors extending between planar surfaces of the multiple conductive contact material, the contact material positioned over the substrate to be continuously in contact with the connectors, the multiple conductive contact material electrically engaging each of the connectors at a large number of separate and isolated electrical engagement regions, the multiple conductive contact material oriented in layers perpendicular to the substrate and each layer having a side edge perpendicular to the substrate and a bottom edge engaging the substrate; and a pressure sensitive conductive elastomeric switch having switch contacts coupled to a pressure sensitive conductive underside, the conductive underside providing switch closure electrical coupling between the switch contacts, the switch disposed in perpendicular relationship to the connectors of the substrate to force the conductive underside into engagement with the conductors, the elastomeric switch having resiliency to provide a return bias force tending to maintain the switch contacts in an open condition and being biased toward a nonactuated, open contact position at the switch contacts, and the conductive underside being coupled into switch closure engagement with the switch contacts and electrically coupling the conductors and the connectors to the closed switch contacts in response to operator actuation of the pressure sensitive conductive underside; and an insulative housing for supporting the pressure sensitive conductive elastomeric switch resting against the multiple conductive contact material and biasing the multiple conductive contact material to press against the conductive traces on the substrate.

* * * * *